United States Patent [19]

Lund

[11] 4,170,949

[45] Oct. 16, 1979

[54] NEEDLE BAR FOR A TUFTING MACHINE

[75] Inventor: Kenneth Lund, Accrington, England

[73] Assignee: Edgar Pickering (Blackburn) Limited, Blackburn, England

[21] Appl. No.: 884,195

[22] Filed: Mar. 7, 1978

[30] Foreign Application Priority Data

Mar. 16, 1977 [GB] United Kingdom ..... 11174/77

[51] Int. Cl.[2] ..... D05C 15/00

[52] U.S. Cl. ..... 112/79 R; 112/226

[58] Field of Search ..... 112/79 R, 79 A, 226, 112/163

[56] References Cited

U.S. PATENT DOCUMENTS

| | | | |
|---|---|---|---|
| 2,563,916 | 8/1951 | Brussell | 112/163 |
| 3,019,748 | 2/1962 | Card | 112/79 R |
| 4,014,278 | 3/1977 | Jolley et al. | 112/79 R |

*Primary Examiner*—Ronald Feldbaum

*Attorney, Agent, or Firm*—Watson, Cole, Grindle & Watson

[57] ABSTRACT

A needle bar for a tufting machine, comprising a main bar having a row of holes uniformly spaced at a coarse pitch, a multiplicity of contiguous segments fitted into a longitudinal location groove in one face of the main bar, each segment having a peg accommodated in one of said holes in the main bar and retained therein by a locking screw and a row of finer holes, disposed parallel to the holes in the main bar and uniformly spaced at a finer pitch than the holes in the main bar, and needles mounted in groups in the holes in the segments to extend away from the main bar and retained in said holes by locking screws, the number of needles in each group being equal.

3 Claims, 4 Drawing Figures

| N | G |
|---|---|
| 2 | 5/16" |
| 4 | 5/32" |
| 5 | 1/8" |
| 8 | 5/64" |
| 10 | 1/16" |
| | |

A

| N | G |
|---|---|
| 2 | 3/8" |
| 3 | 1/4" |
| 4 | 3/16" |
| 6 | 1/8" |
| 8 | 3/32" |
| 12 | 1/16" |

B

| N | G |
|---|---|
| 2 | 1/4" |
| 4 | 1/8" |
| 5 | 1/10" |
| 8 | 1/16" |
| | |
| | |

C

| N | G |
|---|---|
| 2 | 9/32" |
| 3 | 3/16" |
| 4 | 9/64" |
| 6 | 3/32" |
| 9 | 1/16" |
| | |

D

NEEDLE BAR FOR A TUFTING MACHINE

The conventional needle bar for a tufting machine consists of a massive bar, of rectangular cross section, conveniently 1" square, which is reciprocated vertically by push rods and is formed, at uniform pitch, with vertical throughgoing holes into which the shanks of the needles are fitted and secured in position by screws fitted into horizontally extending throughgoing holes in the bar.

Difficulty arises, however, in the manufacture of the needle bar when the gauge of the machine, i.e. the spacing between adjacent needles, is required to be very fine, e.g. 1/16" or 1/10". Thus in a typical case, a needle bar 172½" long may require to be drilled with no less than 1662 holes, each having a diameter of 0.08", disposed at a pitch of 0.10". Since the required drill is extremely fine, it is extremely difficult to drill these holes accurately and in the event of error the entire needle bar must be scrapped.

It is possible to mitigate this difficulty by the use of a staggered needle bar, having two rows of needles with the needles in one row pitched midway between those in the other row. This expedient is not, however, available in the case of fine gauge machines for making cut pile fabric because there is insufficient clearance between the needles in the two rows for the passage of the loopers, which catch the loops of yarn projected through the backing fabric by the needles.

The invention provides a needle bar for a tufting machine, comprising a main bar having a row of holes uniformly spaced at a coarse pitch, a multiplicity of contiguous segments fitted into a longitudinal location groove in one face of the main bar, each segment having a peg accommodated in one of said holes in the main bar and retained therein by a locking screw and a row of finer holes, disposed parallel to the holes in the main bar and uniformly spaced at a finer pitch than the holes in the main bar, and needles mounted in groups in the holes in the segments to extend away from the main bar and retained in said holes by locking screws, the number of needles in each group being equal.

Figure 1:
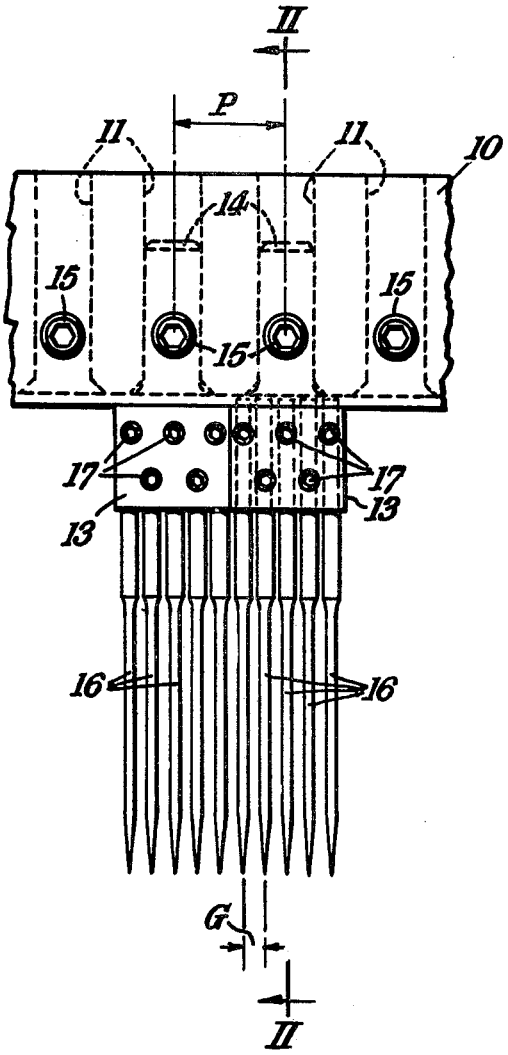
Figure 2:
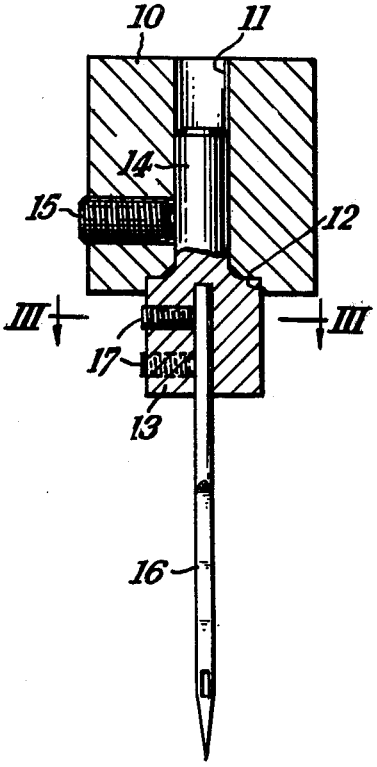
Figure 3:
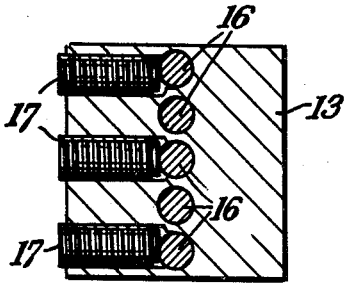
Figure 4:
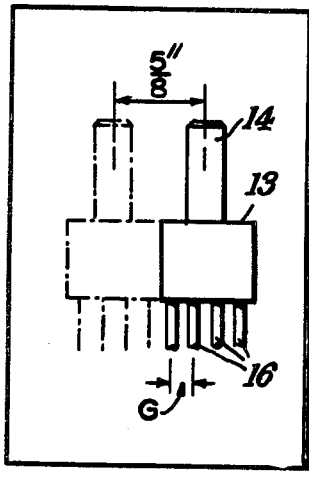
Figure 4:
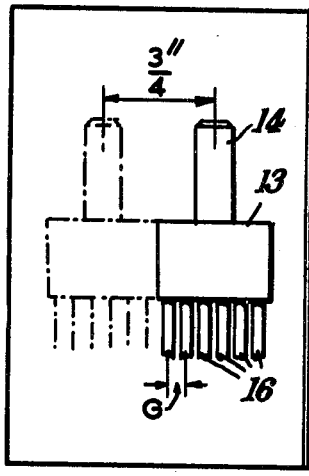
Figure 4:
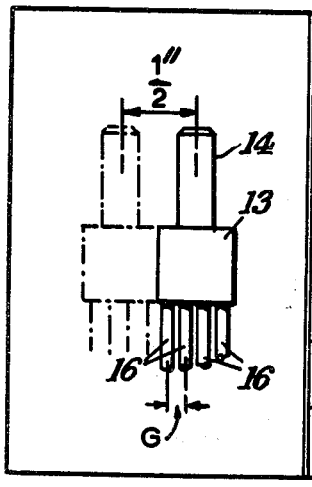
Figure 4:
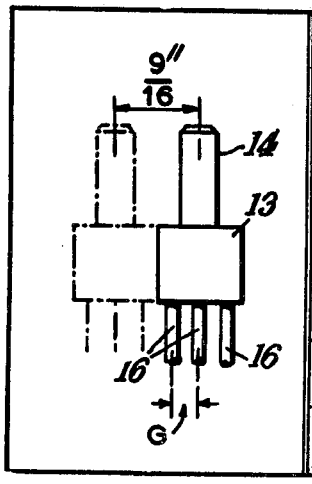

The invention will now be further explained with reference to the accompanying drawings in which:

FIG. 1 is a side elevation of part of the needle bar according to the invention, FIG. 2 is a section on the line II—II in FIG. 1, FIG. 3 is a section on the line III—III in FIG. 2, and FIG. 4 is a series of diagrams illustrating the relation between the positioning of the needles in the segments attached to the main bar and the gauge of the machine.

The needle bar shown in FIGS. 1-3 includes a main bar 10, of 1" cross section, which when installed in a tufting machine is connected to vertically disposed push rods, not shown, by which it is reciprocated in the conventional way to cause needles 16 to pierce a backing fabric fed through the machine and project loops of yarn through the fabric.

The bar 10 has throughgoing vertical holes 11 of ¼" diameter, pitched at a pitch P of ½", and a location groove 12 in its undersurface into which are fitted numerous abutting segments 13, each having a peg 14 which extends upwardly into one of the holes 11 and is secured in place by a locking screw 15, accommodated in a screw-threaded hole in the bar 10 which extends at right angles to the groove 11. Each of the segments 13, which is ½" in length, carries a number of aligned downwardly projecting needles 16, accommodated in equally spaced finer holes in the segment and secured by staggered clamping screws 17, accommodated in upper and lower rows of screw-threaded holes in the segment 13 which extend at right angles to the holes accommodating the needles 16. As will be seen from FIG. 1, the screws 17 for the outermost needles 16 are disposed off-centre with respect to the needles to ensure that they will not break through the wall of the segment.

The machine gauge is determined by the number of needles carried by each segment. When this is five, as shown, the gauge G is 1/10".

The fine needle-accommodating holes in the segments 13 must be accurately drilled. In the event of a fault in manufacture it is only necessary to discard a faulty segment 13 and not the whole needle bar.

As shown in FIG. 4, a wide range of machine gauges can be achieved by the use of main needle bars 10 with holes 11 at different pitch.

In FIG. 4, which consists of four diagrams A, B, C and D, N denotes the number of needles 16 per segment 13 and G the machine gauge.

In diagram A the pitch P (FIG. 1) of the holes 11 is ⅝", which will yield gauges G ranging from 1/16" to 5/16" as the number N of needles per segment is varied from 12 to 2.

Diagrams B, C and D show respectfully pitches P of ¾", ½" and 9/16" from which machine gauges G which are sub-multiples of these pitch dimensions can be established by appropriate choice of the number N of needles on each segment, as indicated at the right hand side of each diagram.

Thus by stocking a selection of main needle bars 10 of different hole pitch P and appropriate corresponding segments 13 a wide range of machine gauges G can readily be obtained.

What I claim as my invention and desire to secure by Letters Patent is:

1. A needle bar for a tufting machine, comprising a main bar having a row of holes uniformly spaced at a coarse pitch, a multiplicity of contiguous segments fitted into a longitudinal location groove in one face of the main bar, each segment having a peg accommodated in one of said holes in the main bar and retained therein by a locking screw and a row of finer holes, disposed parallel to the holes in the main bar and uniformly spaced at a finer pitch than the holes in the main bar, and needles mounted in groups in the holes in the segments to extend away from the main bar and retained in said holes by locking screws, the number of needles in each group being equal.

2. A needle bar according to claim 1, wherein the locking screws retaining the needles in each segment are disposed in two rows in staggered relationship.

3. A needle bar according to claim 2, wherein the locking screws retaining the outermost needles in each segment are disposed off-centre with respect to the needles.

* * * * *